US006592094B1

(12) United States Patent
Kao

(10) Patent No.: US 6,592,094 B1
(45) Date of Patent: Jul. 15, 2003

(54) TREE STABILIZING BASE

(75) Inventor: Cheung Chong Kao, Chai Wan (HK)

(73) Assignee: Boto (Licenses) Limited, Douglas (GB)

( * ) Notice: Subject to any disclaimer, the term of this patent is extended or adjusted under 35 U.S.C. 154(b) by 0 days.

(21) Appl. No.: 10/058,742

(22) Filed: Jan. 28, 2002

(51) Int. Cl.[7] ..... A47G 33/06; A47G 33/12

(52) U.S. Cl. ..... 248/529; 248/519; 248/523; 362/568

(58) Field of Search ..... 248/519, 523, 248/524, 529, 310; 362/568, 123

(56) References Cited

U.S. PATENT DOCUMENTS 2,111,642 A * 3/1938 Saier ..... 431/297
4,159,096 A * 6/1979 Chase ..... 248/523
4,260,365 A * 4/1981 Kayne ..... 431/291
5,713,554 A * 2/1998 Lai ..... 248/522
6,065,233 A * 5/2000 Rink ..... 40/607
6,438,879 B1 * 8/2002 Kao ..... 40/431

* cited by examiner

*Primary Examiner*—Ramon O. Ramirez
*Assistant Examiner*—Jon Szumny
(74) *Attorney, Agent, or Firm*—G. Brian Pingel; Camille L. Urban

(57) ABSTRACT

The present invention provides stability for a decorative tree. Specifically, the decorative tree will have a base part, the lower section of which fits into a stand assembly and an upper section of which includes receiving means for an internal sleeve. The internal sleeve is sized to snugly receive a tree trunk and is formed to provide a plurality of clearances between the internal sleeve and the base part to accommodate parts associated with the trunk of the decorative tree such as bundles of fiber optics. By separating the parts to be associated with said trunk from the trunk, the stability of the entire decorative tree is vastly improved

12 Claims, 7 Drawing Sheets

TREE STABILIZING BASE

BACKGROUND OF THE INVENTION

1. Field of the Invention

The present invention relates in general to an apparatus for stabilizing artificial Christmas or decorative trees. More specifically, the present invention provides stability at the base of an artificial tree by providing a tighter fit within a sleeve of the base.

2. Description of the Prior Art

It is known in the art to provide artificial trees for decoration. Such trees are equipped with a base and stand such that the tree is free-standing. Some stands include feet, and some are simply circular. Most of the prior art devices include a base piece wherein one end fits around the trunk of the artificial tree and the other end fits into the stand. Many of these base pieces are simply hollow cylinders and some are integrally associated with the stand.

In the prior art, the circumference of the base piece or hollow cylinder had to be of such a size that not only the trunk of the artificial tree could be inserted, but also any parts that needed to be associated with or aligned with the trunk. For example, bark if the trunk is wood or some other substance if the trunk is not; optical fibers if they are to be distributed in various parts of the tree; electric or light cords; or brackets for low branches. As the circumference of the base piece was increased to accommodate these other parts, the stability of the tree was severely impaired by the give and softness such pieces introduced between the trunk and the inside surface of the base piece.

The present invention differs from the above referenced inventions and others similar in that these prior devices do not provide a way to allow for the parts that need to be associated with the trunk of the tree without sacrificing the tree's stability. Therefore, it is one objective of the present invention to accommodate associated parts separately from the trunk. It is a second objective of the present invention to increase the stability of a decorative tree.

SUMMARY OF THE INVENTION

The present invention provides stability for a decorative tree having a base part, the lower section of which fits into a stand assembly. An upper section of the base part includes receiving means for an internal sleeve which is sized to receive a tree trunk and is formed to provide a plurality of clearances to accommodate parts associated with the trunk of the decorative tree. Generally, said means to receive the trunk is a hollow cylinder with inner and outer surfaces and of a size into which said trunk fits snugly. Said plurality of clearances are bounded by a plurality of protrusions on the outer surface of the internal sleeve and the inner surface of the base part. By separating the parts to be associated with said trunk from the trunk by using said plurality of protrusions and clearances, and by providing means to receive and snugly fit the trunk, the stability of the entire decorative tree is vastly improved Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DESCRIPTION OF THE PREFERRED EMBODIMENT(S)

Figure 1:
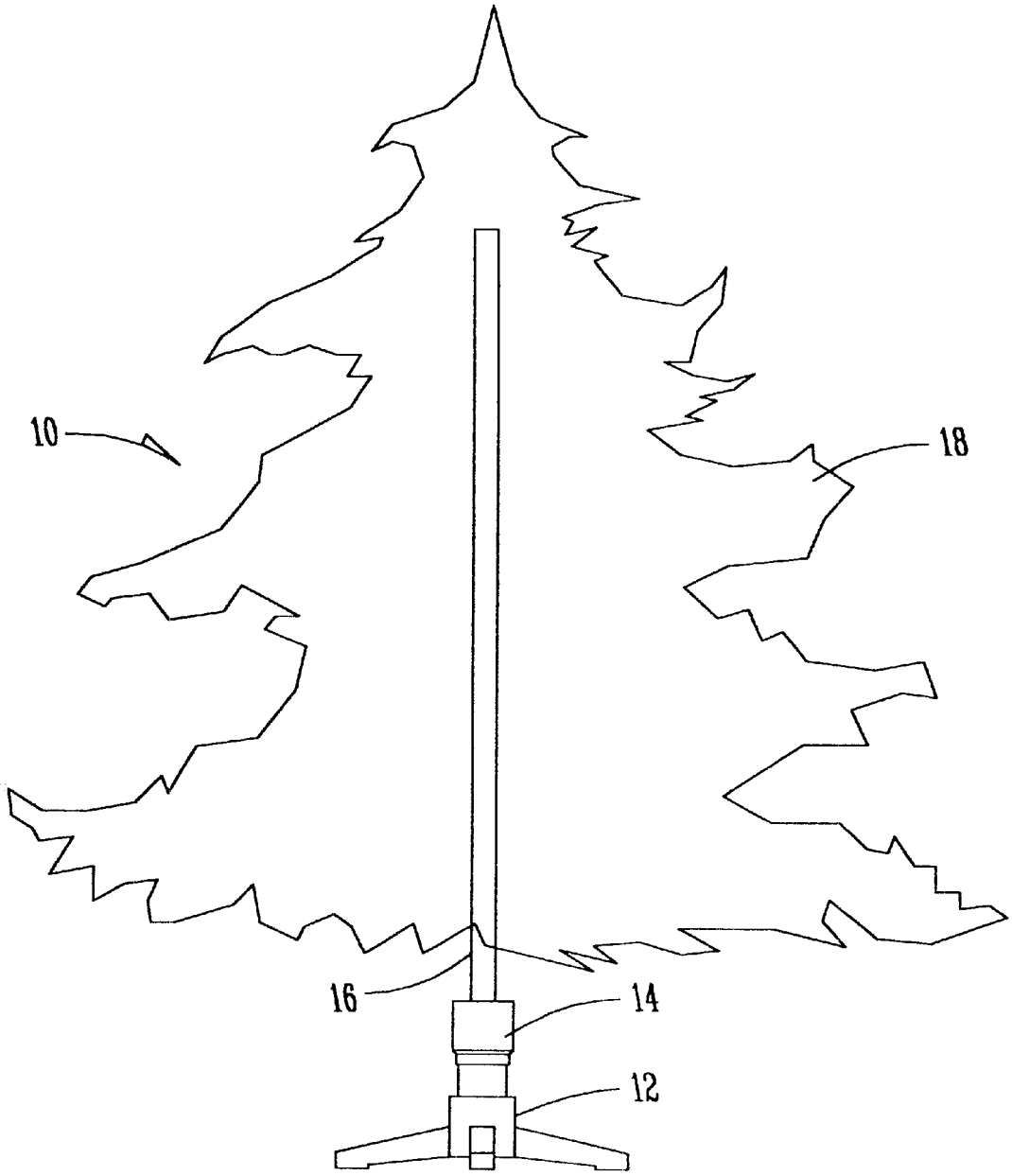
FIG. 1 perspective of decorative tree showing base part and stand assembly.

Referring to FIG. 1, a preferred embodiment of the present invention is shown and includes a decorative tree 10 which includes a stand assembly 12, a base part 14, a trunk 16 and tree branches 18.

Figure 2:
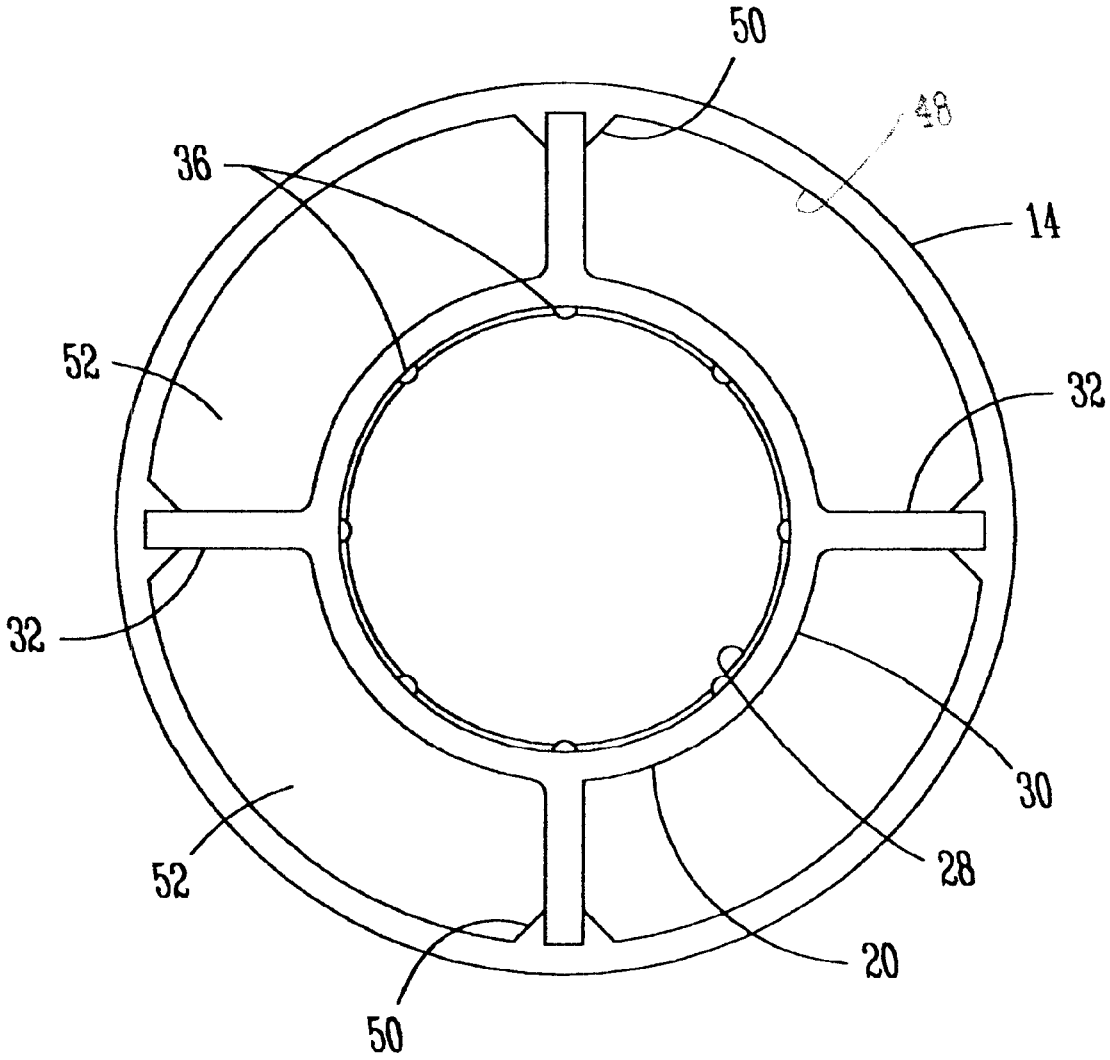
FIG. 2 cross section of base part detailing insertion of internal sleeve.
Figure 3:
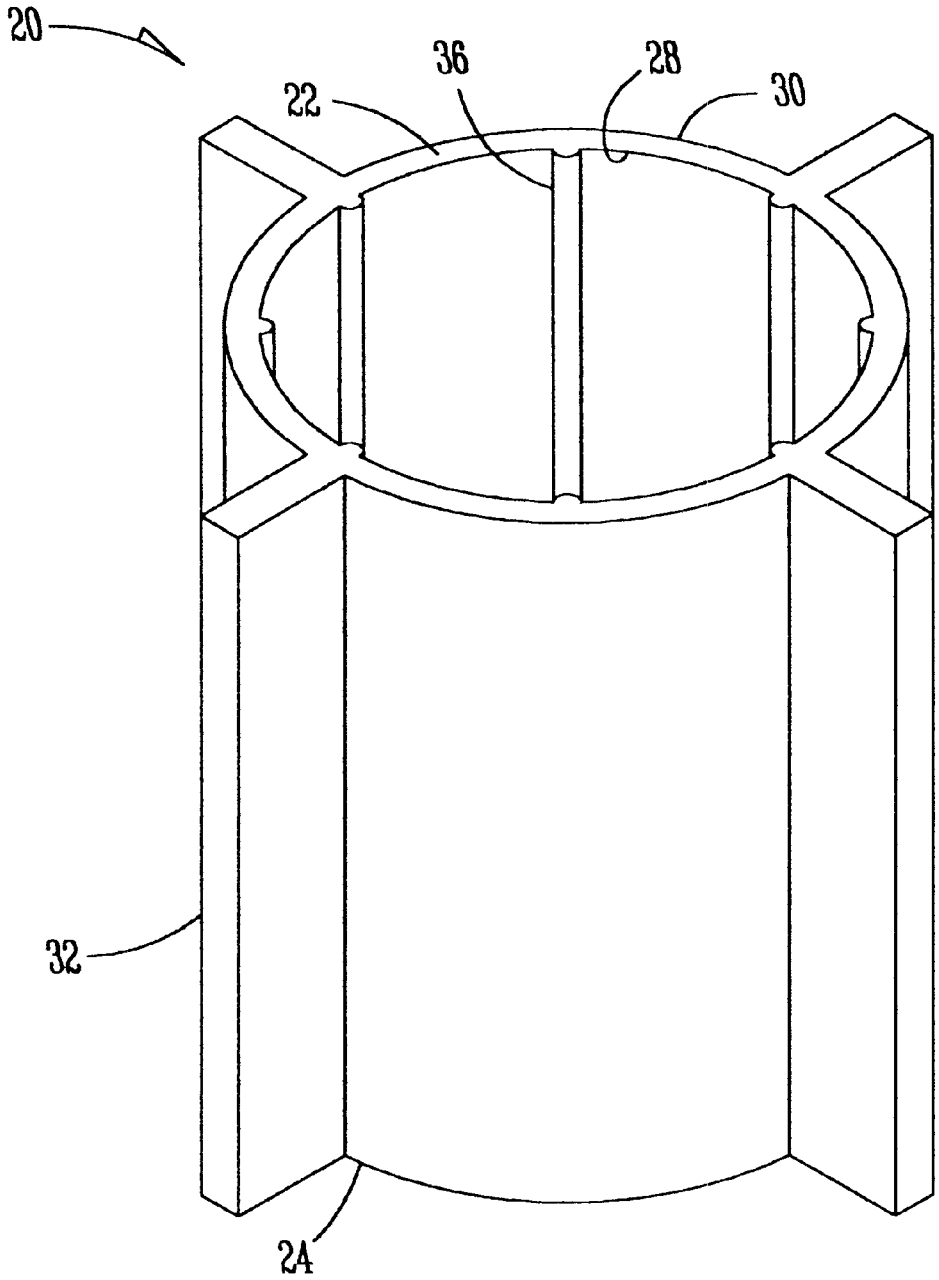
FIG. 3 perspective of internal sleeve showing protrusions.
Figure 4:
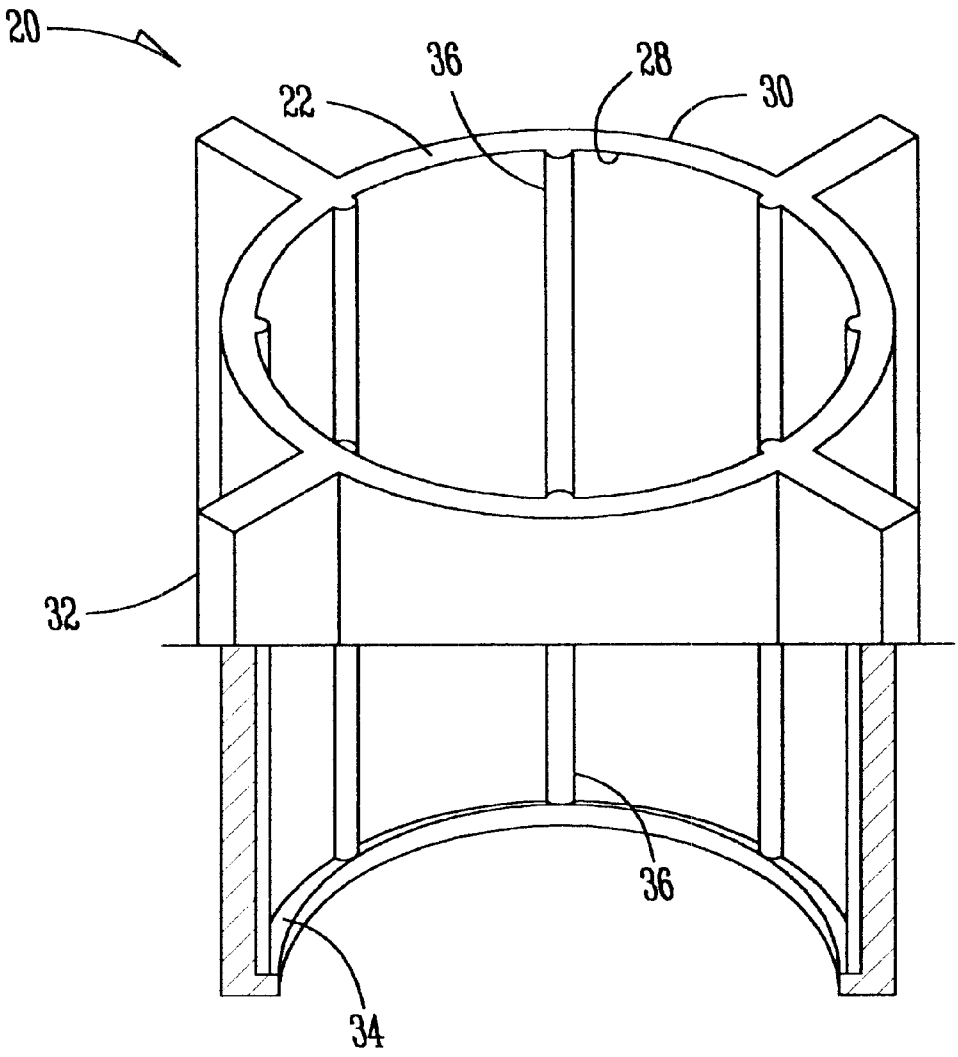
FIG. 4 perspective of internal sleeve but with cut away to show inner surface.

As best shown by the cross-section in FIG. 2, an internal sleeve 20 functions as a means to receive said trunk 16 and comprises bottom and top ends 22 and 24 respectively (see also FIG. 3), a cylindrical shaped body 26 with an inner surface 28, an outer surface 30, a plurality of protrusions 32 which are spaced apart along said outer surface 30 of said internal sleeve 20 and run longitudinally thereof between said bottom and top ends 22, 24. Best shown in FIG. 4, a lip 34 runs around the internal surface 28 at the bottom end 22. In the preferred embodiment, the internal surface 28 of said internal sleeve 20 is provided with numerous spaced apart, longitudinally aligned friction strips 36 that are tapered in height running from bottom to top to increase the amount of friction they present to the trunk 16 as it is inserted into the sleeve 20 to create a tight, fit therebetween.

Figure 5:
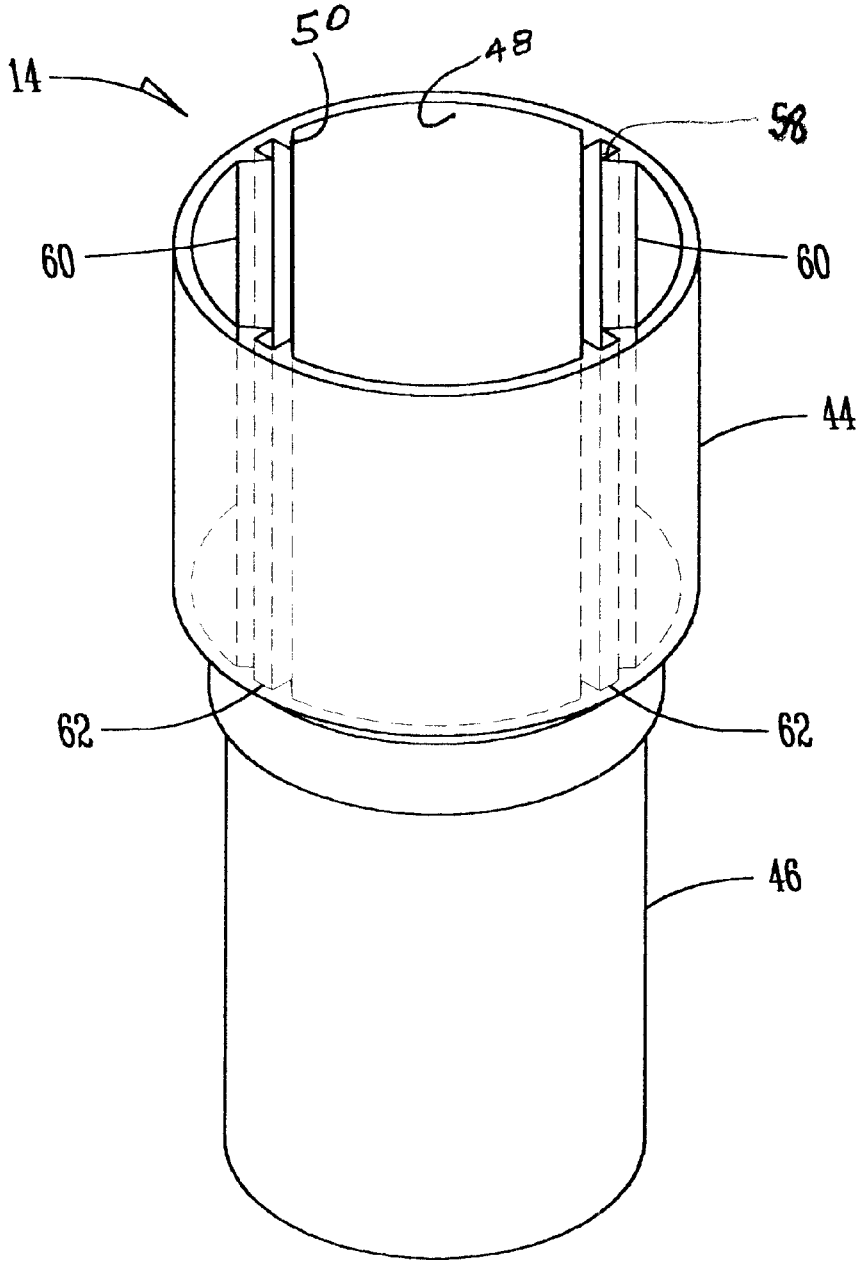
FIG. 5 perspective of base part.

Said base part 14 (shown in FIG. 5) comprises upper and lower sections 44 and 46 respectively, an inner surface 48 and means 50 to receive each of said protrusions 32 for securing said internal sleeve 20 in position within said base part 14. When the sleeve 20 is assembled within the base part 14, spaces 52 are formed between the outer surface 30 of the sleeve 20 and the inner surface 48 of the base part 14. The internal sleeve 20 is stabilized by the association of said protrusions 32 and said means 50 to receive them located on the inner surface 48 of said base part 14.

In the preferred embodiment, said means 50 to receive said protrusions 32 comprises channels 58 formed by closely spaced apart elongated ribs 60 into which the protrusions 32 slide. Each of the channels is equipped with a stop tab 62 at the lower edge of the channels to prevent said sleeve 20 from falling out of the channels 58. See FIG. 4.

Figure 6:
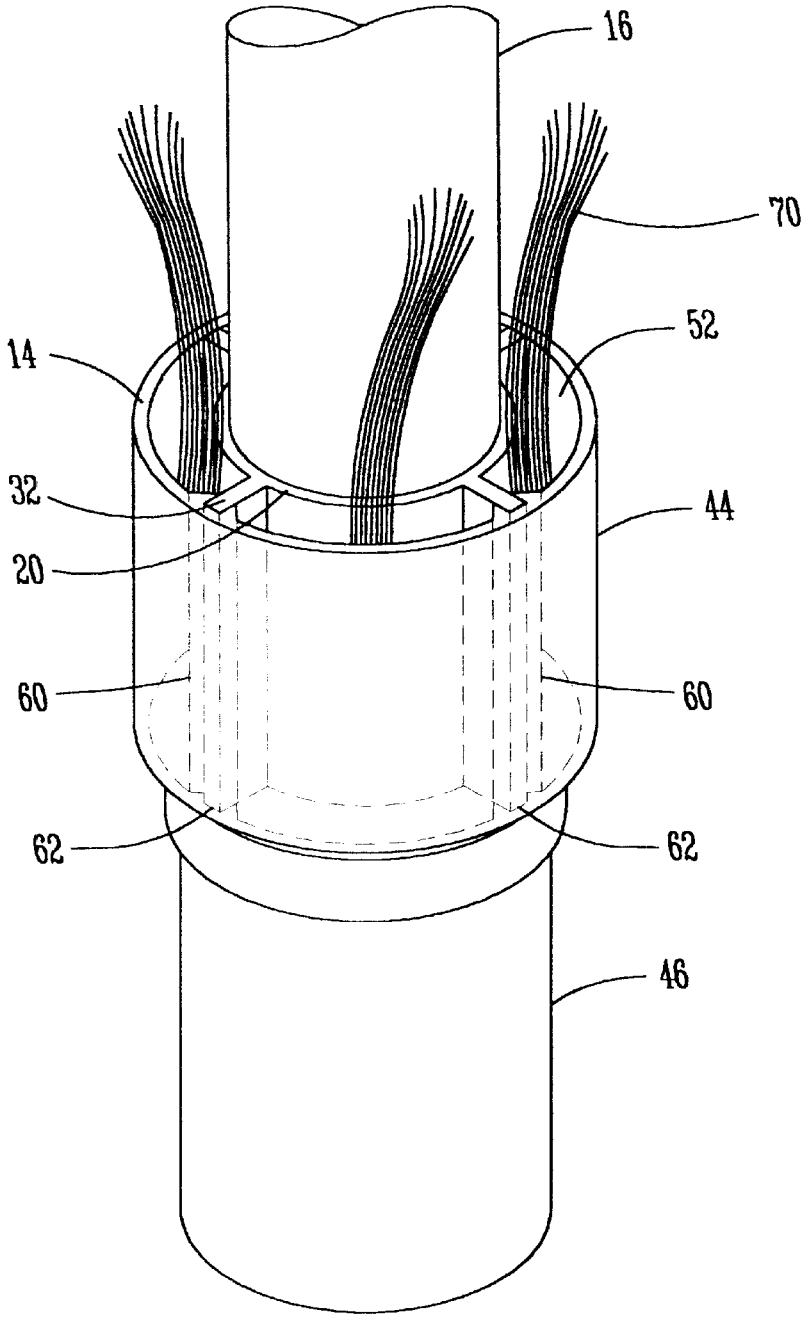
FIG. 6 perspective of base part with internal sleeve, trunk, and fiber optic bundles FIG. 7 cut away view of the base part and stand assembly of FIG. 1.
Figure 7:
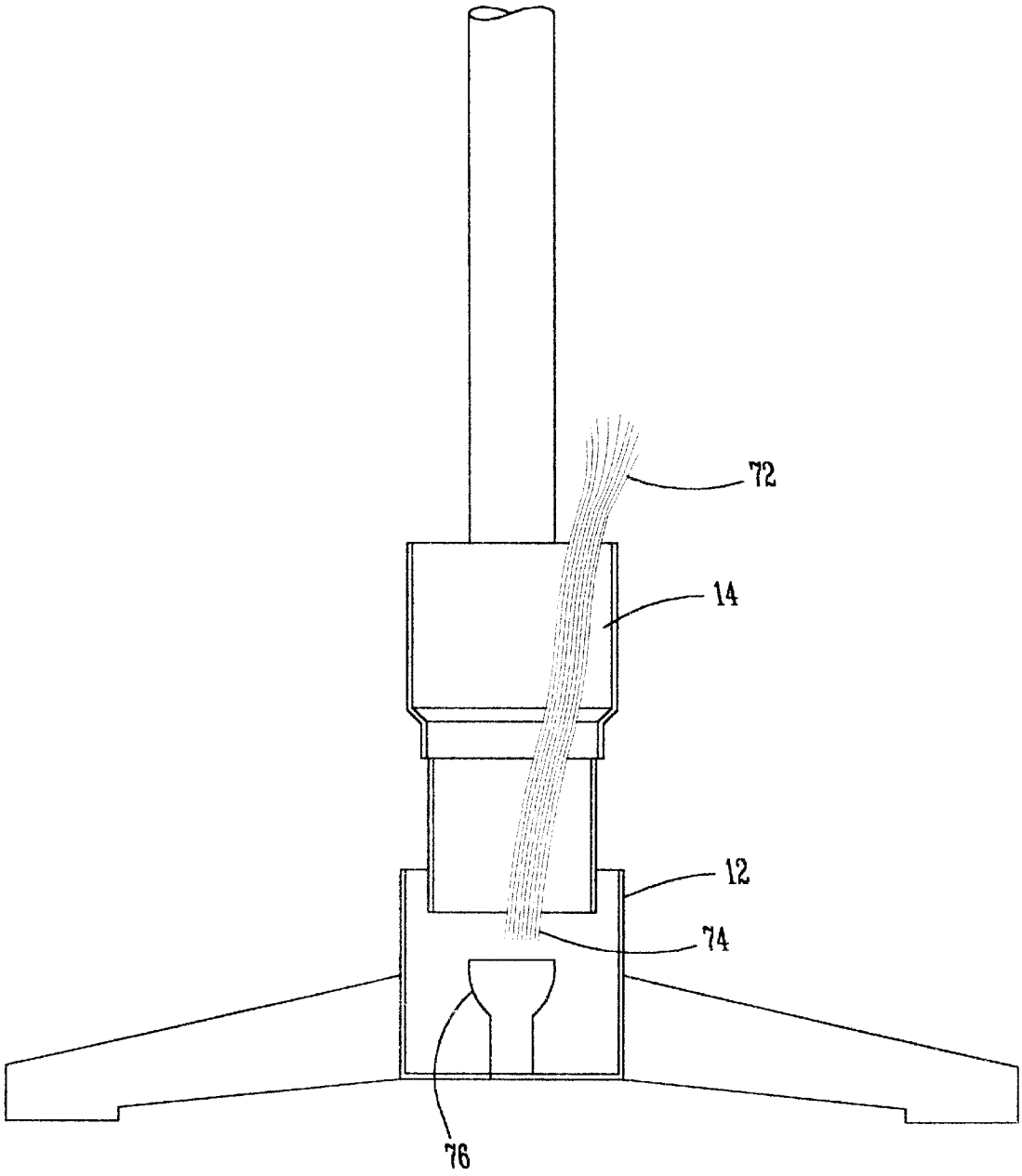

In the preferred embodiment shown in FIG. 6, the invention provides stability for a Christmas tree illuminated by optical fibres 70. First, the internal sleeve 20 is inserted into said base part 14 by sliding the protrusions 32 into said channels 58 to the stops 62. Said internal sleeve 20 should be oriented such that said inside lip 34 is near the stop tabs 62 at the lower edge of the channels 58 of said base part 14. It is against this lip 34 that said trunk 16 will rest.

Said fibres 70 each comprise a distal 72 and a proximal end 74. All proximal ends 72 of said fibres 70 are located in bundles near a light source 76 in said stand assembly 12. Each bundle of fibres 70 is then threaded through one of said spaces 52 created between said inner surface 48 of said base part 14 and the outer surface 30 of said internal sleeve 20. The base part 14 is then secured to said stand assembly 12 such that said proximal ends 74 are near said light source 76.

Next, said trunk 16 is inserted in the internal sleeve 20 where it is gripped tightly by said friction strips 36 and until it reaches the inside lip 34 which functions as a stop. Finally, above the internal sleeve 20, said optical fibres 70 are associated with said trunk 16 and are directed to said tree branches 18.

Thus, the present invention has been described in an illustrative manner. It is to be understood that the terminology that has been used is intended to be in the nature of words of description rather than of limitation.

Many modifications and variations of the present invention are possible in light of the above teachings. Therefore, within the scope of the appended claims, the present invention may be practiced otherwise than as specifically described.

What I claim is:

1. An apparatus for stabilizing a decorative tree with a trunk having a circumference, said apparatus comprising:

(a) a stand assembly with receiving means;

(b) a base part comprising an internal surface and lower and upper sections wherein said lower section fits into said receiving means of said stand assembly;

(c) an internal sleeve comprising an inner surface of generally the same shape and slightly larger than said circumference of said trunk so that said trunk can be snugly received in said sleeve and is supported thereby, an outer surface, and a plurality of spaced apart protrusions mounted on said outer surface; and (d) said upper section of said base part further comprising means to receive said protrusions mounted on said internal surface of said base part such that a plurality of clearances is formed between the combination of said protrusions, said internal surface of said base part, and said outer surface of said internal sleeve and said internal sleeve is secured relative to said base part.

2. An apparatus as claimed in claim 1 for stabilizing a decorative tree wherein said internal sleeve further comprises top and bottom ends, friction strips mounted on said inner surface of said sleeve and an inside lip at said bottom end.

3. An apparatus as claimed in claim 2 for stabilizing a decorative tree wherein said means to receive said protrusions comprises a plurality of longitudinally aligned channels generally equal in length to said upper section of said base part and in which said protrusions are slidably received.

4. An apparatus as claimed in claim 3 for stabilizing a decorative tree wherein said channels further comprise an open end and a closed end.

5. An apparatus for stabilizing a decorative tree with a cylindrically shaped trunk and a plurality of branch elements, said apparatus comprising:

(a) a base part comprising an inner surface, a lower section and an upper section;

(c) a stand assembly comprising a light source and means to receive said lower section of said base part;

(d) an internal sleeve of cylindrical shape of generally the same size as said trunk for snugly receiving same and comprising a bottom end, a top end, an internal surface, an outer surface, tapered friction strips mounted on said internal surface for gripping said trunk and a plurality of protrusions running from said bottom end to said top end and mounted on said outer surface; and (e) said base part further comprising means for attaching said plurality of protrusions to said inner surface of said upper section of said base part such that a plurality of clearances are formed between the combination of said plurality of protrusions and said means for attaching said protrusions, said inner surface of said base part, and said outer surface of said internal sleeve.

6. An apparatus as claimed in claim 5 for stabilizing a decorative tree further comprising:

(a) a plurality of optical fibres each comprising a distal and a proximal end wherein said distal ends are distributed in said branch elements; and (b) said proximal ends of said optical fibres are gathered into a plurality of bundles each of which is threaded through one of said plurality of clearances such that said light source in said stand assembly provides light to said proximal ends of said optical fibres.

7. An apparatus as claimed in claim 6 for stabilizing a decorative tree, wherein said plurality of protrusions further comprise ribs which run from said bottom end to said top end of said internal sleeve and said means for attaching said protrusions to said inner surface of said upper section of said base part further comprises open channels recessed into said inner surface of said upper section which have a first and second end wherein said first end is open and said second end is closed.

8. An apparatus for stabilizing a decorative tree having a trunk and a plurality of branch elements, said apparatus comprising:

(a) an internal sleeve shaped to receive said trunk and further comprising means to friction-arrest slippage of said trunk therein;

(b) a base part comprising a lower section and an upper section;

(c) a stand assembly with means to receive said lower section of said base part;

(d) said internal sleeve further comprising an outer surface upon which are mounted a plurality of protrusions;

(e) said base part further comprising an inner surface upon which are mounted protrusion-receiving means and into which said plurality of protrusions on said outer surface of said internal sleeve fit; and (f) a plurality of clearances bounded by the combination of said inner surface of said upper section of said base part, said protrusions mounted on said outer surface of said internal sleeve and received by said receiving means, and said outer surface of said internal sleeve.

9. An apparatus as claimed in claim 8 stabilizing a decorative tree further comprising:

(a) said means to friction-arrest slippage of said trunk comprise friction strips;

(b) said internal sleeve further comprises a bottom end and a top end; and (c) said friction strips are tapered in height and run from said bottom end to said top end.

10. An apparatus for stabilizing a decorative tree with a trunk having a circumference, said apparatus comprising:

a. A stand assembly with receiving means;

b. A base part comprising an internal surface and lower and upper sections wherein said lower section fits into said receiving means of said stand assembly;

c. An internal sleeve comprising an inner surface of generally the same shape and slightly larger than said circumference of said trunk so that said trunk can be snugly received in said sleeve and is supported thereby, an outer surface, and a plurality of spaced apart protrusions mounted on said outer surface;

d. Said upper section of said base part further comprising means for attaching said protrusions such that a plurality of clearances is formed between the combination of said protrusions, said internal surface of said base part, and said outer surface of said internal sleeve and said internal sleeve is secured relative to said base part; and e. Said internal sleeve further comprises top and bottom ends, friction strips mounted on said inner surface of said sleeve and an inside lip at said bottom end.

11. An apparatus as claimed in claim 10 for stabilizing a decorative tree wherein said means to receive said protrusions comprises a plurality of longitudinally aligned channels generally equal in length to said upper section of said base part and in which said protrusions are slidably received.

12. An apparatus as claimed in claim 11 for stabilizing a decorative tree wherein said channels further comprise an open end and a closed end.

* * * * *